United States Patent [19]

Ambasz

[11] 4,043,063

[45] Aug. 23, 1977

[54] APPOINTMENT CALENDAR BOOK

[75] Inventor: Emilio Ambasz, New York, N.Y.

[73] Assignee: Center for Design Research and Development N.V., Curacao, Netherlands Antilles

[21] Appl. No.: 671,832

[22] Filed: Mar. 30, 1976

[51] Int. Cl.[2] ..... G09D 3/04

[52] U.S. Cl. ..... 40/119; 40/102

[58] Field of Search ..... 40/107, 119–122, 40/102, 158 R, 159, 104.17–104.19, 10 D

[56] References Cited

U.S. PATENT DOCUMENTS 2,831,279 4/1958 Esslinger, Jr. ..... 40/119

FOREIGN PATENT DOCUMENTS 754,946 9/1933 France ..... 40/104.18

465,556 1/1969 Switzerland ..... 40/104.19

*Primary Examiner*—Louis G. Mancene

*Assistant Examiner*—Robert P. Swiatek

*Attorney, Agent, or Firm*—Brumbaugh, Graves, Donohue & Raymond

[57] ABSTRACT

An appointment calendar comprises a ring-type binder, at least one page having a pocket and a flap which partially slips into the pocket, and an insertion having two leaves, one of the leaves being received in the pocket to hold the insertion in place in the calendar and the other leaf, which contains printed promotional, decorative or informative matter, overlying the pocket so that the printed matter is visible. The pocket is closed along all margins except along an opening adjacent the edge of the page that is engaged in the binder. The binder rings engage the flap and a part of the page which is non-pocketed but do not engage the pocket or the insertion.

2 Claims, 3 Drawing Figures

CONTRIBUTORS TO ART SHOW
MR
MRS
MRS
DR
GEN
MRS
M 6 08
T 6 09
W 6 10
T 6 11
F 6 12
S 6 13
S 6 14
M 6 15
T 6 16
W 6 17
T 6 18
F 6 19
S 6 20
S 6 21

APPOINTMENT CALENDAR BOOK

BACKGROUND OF THE INVENTION

The present invention relates to an appointment calendar having one or more pages for displaying promotional, decorative or informative matter and, more particularly, to a novel and improved appointment calendar page which contains documentary insertions received in a page-like structure with an easily accessible pocket.

Calendar or appointment books are often given away or sold as advertising or promotional material or for fund-raising by businesses, museums, clubs and other institutions. It is necessary with known calendar or diary books to limit the amount of space devoted to matter promoting the sponsor of the calendar because the inclusion of such matter as permanent print diminishes the space available in the book for use as a personal appointment or events calendar. Also, appointment book pages make no provision for division, storage, or protection of documents or memoranda according to the time period covered by each page, thus limiting the use of the book to merely entering notations. Furthermore, appointment books are often used as a permanent record of events or appointments. However, because the pages have no reinforcement at the point of engagement with the binder, pages are easily torn out and lost.

SUMMARY OF THE INVENTION

There is provided, in accordance with the present invention, an appointment or events calendar book which includes documentary, promotional or informative matter without detracting from the use of the pages as an appointment or events calendar. More particularly, the invention comprises a ring-type binder and as one or more pages of the calendar a page having a pocket that opens toward the inner or binder edge of the page. The pocket holds as an insertion the documentary or promotional matter in place so that it is displayed, but still easily removed, the insertion being folded to provide two leaves, one of which is slipped into the pocket and the other of which overlies the pocket such that it is visible. The pocket can also be used for storage and protection of documents and memoranda relating to the dates covered by the page.

Each special page of the book also includes a flap along the inner edge of the page. The flap is folded so that it partially slips into the pocket. Two sets of binder holes are made in the page — one set in the flap and the other set in the non-pocketed portion of the page. When the page is engaged in the binder, the binder rings engage the flap and the non-pocketed portion of the page but not the pocket or the insertion. Such an arrangement results in reinforcement of the page at the point of engagement but does not interfere with access to the pocket or insertion.

The appointment calendar page can be made in the same way as an envelope, i.e, by folding a single, generally rectangular sheet or "blank" of material, for example, vertically along a line perpendicular to the top edge of the sheet and to the left of center of the rectangle. The fold results in two leaves which are then bound (e.g., by gluing) together along the top and bottom edges creating a pocket. For example, flaps along the top and bottom edges of one of the leaves can be folded and glued to the other leaf. The non-pocketed portion of the sheet is folded vertically to create a flap which extends a short distance into the pocket.

A calendar or diary book can consist entirely or only partly of the special pocketed pages, regular pages being interleaved with special pages in the former case, and either face or both faces of each special page may be printed with dates and lined off for weekly, dialy or hourly entries. The documentary or promotional insertions can be slipped into any of the pockets in the book, and the user may elect to remove them, leave them in place or move them from one pocket to another. Folded insertions prepared by the user, such as important reminder notes, are readily put in the book in the same way as original insertions.

BRIEF DESCRIPTION OF THE DRAWINGS

For a better understanding of the invention, reference may be made to the following description of an exemplary embodiment taken in conjunction with the figures of the accompanying drawings, in which.

DESCRIPTION OF THE PREFERRED EMBODIMENT

Figures 1, 2, 3:
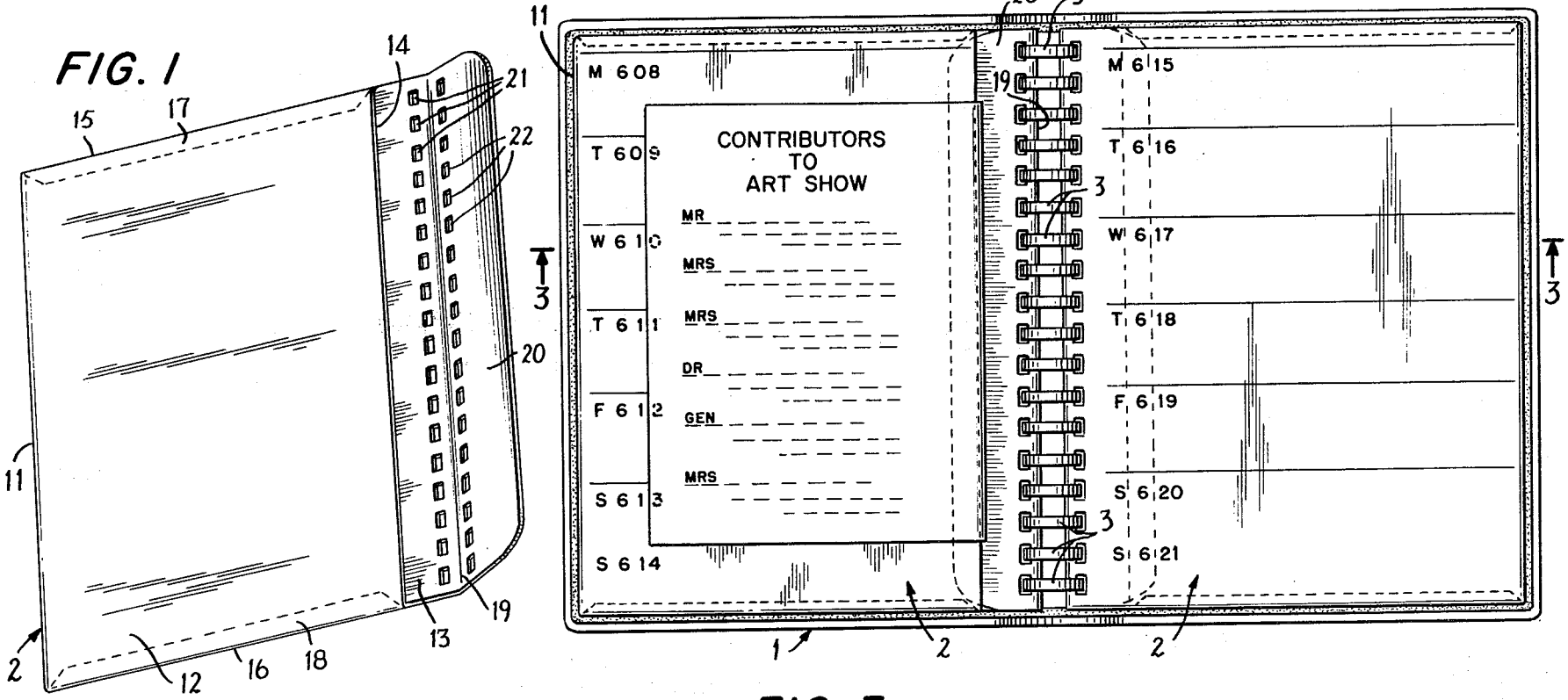
FIG. 1 is a perspective view of an appointment calendar page, except that it does not show either the printed matter on the page or the insertions.
FIG. 2 is a plan view of a binder containing appointment calendar pages.
FIG. 3 is a sectional view taken along line 3—3 of FIG. 2.

Referring to FIG. 3, a representative embodiment of the appointment calendar, in accordance with the present invention, comprises a binder 1 composed of front and back covers **1*a* and 1*b* and containing anumber of pages 2 suitably fastened therewithin. Any of a variety of binders 1 is suitable, the one shown being a ring binder composed of a series of fingers 3 of metal or plastic joined by a strip 4 along the back of the binder 1. Other suitable forms of binder 1** include a looseleaf notebook type and the spiralwire types. The pages of the calendar book may consist entirely of special pages, as hereinafter described and as shown in the drawings, or may be composed of the special pages interleaved with single sheets, i.e., ordinary pages.

The special pages 2 have pockets that are closed along the free edges of the pages and open toward the binder rings. It will be apparent that the pockets can be formed in the pages in various ways. In the form shown in the drawings, each page 2 is made from a rectangular sheet or blank of material, such as paper or lightweight card stock, folded along line 11. The resulting top leaf 12 does not completely cover the bottom leaf 13. A pocket 14 is formed by binding the leaves 12 and 13 together along lines 15 and 16. The leaves 12 and 13 are bound by folding flaps 17 and 18 which are attached to leaf 13 and gluing said flaps 17 and 18 to leaf 12. The non-pocketed portion of the bottom leaf 13 is folded along line 19 such that the resulting flap 20 will partially fit into the pocket 14. Two sets of binder holes 21 and 22 are made in the page. One set 21 is made on the non-pocketed portion of the bottom leaf 13, and a corresponding set 22 is made on the flap 20. When the flap 20 is inserted into the pocket 14, the two sets of holes 21 and 22 will coincide.

What results, as shown in FIG. 3, is a page-like structure consisting of a sheet folded at 11 and 19 forming leaves 12 and 13 and leaving a pocket 14. The insertion 23 consists of a sheet of material folded to form two leaves 24 and 25. The insertion 23 is introduced into the pocket 14 so that one leaf 25 fits into the pocket 14 while the other leaf 24 lies on top of the pocket 14 so that leaf 24 is visible to a user of the page. The leaves 12 and 13 are joined along lines 15 and 16, but the seams are not visible in FIG. 3.

It is important to note that the binding rings engage leaf 13 and flap 20 of the appointment calendar page but do not engage leaf 12 or the insertion 23. In this way, the pocket 14 is freely accessible for introduction and removal of the insertion 23. The binding of the flap in the rings of the binder helps keep the flap closed. At the same time, the arrangement results in increased strength at the point of engagement with the binding rings. The increased strength is due to the fact that each binding ring passes through the page twice, i.e, through one binder hole from set 21 and one from set 22.

The pockets in the special pages are used, in the first instance, to receive sheets printed with promotional or decorative subject matter or any generally flat sheets or pages suited to the interests of the sponsor of the calendar book. For example, a business sponsor can insert sheets printed with information concerning the products of the business, samples of products or decorative material consistent with the nature of the business. The types of inserts in the pockets can, of course, be a mixture of decorative and promotional objects. A travel agent might, for example, promote a trip of the month plan with seasonal arrangements of information. A charity might present information on its activities. A museum can insert reproductions of works of art.

The user of the calendar book will find the pockets useful for keeping notes and memoranda, bills and other materials which he wants to keep track of on a calendar basis. The user can also elect to keep the decorative or promotional material in place in the pockets, discard it, or rearrange it. Some users, for example, may select favorite photographs or other information on the insert sheets furnished with the book and move them from time to time so that they are visible when he uses the calendar from week to week or month to month.

It will be understood by those skilled in the art that the above descirbed embodiment is intended to be merely exemplary, and that it is susceptible to modification and variation without departing from the spirit and scope of the invention. All such variations and modifications are intended to be included within the scope of the invention as set forth in the appended claims.

I claim:

1. In an appointment calendar book having a multiplicity of pages bearing indicia of dates thereon and ring-type binder means having elements passing through the pages for securing the pages to form a book, the improvement comprising as at least one page of the book a page-like structure having a pocket closed along its margins except along an opening that is closely adjacent the edge of the structure through which said elements of the binder means pass ahd having a flap joined intergrally to said edge and folded to overlie a portion of said page-like structure adjacent said edge, the flap being of a width such that it is adapted to be partially received in the pocket through said opening, and the elements of the binding means passing through the flap and a part of the structure which is non-pocketed but not passing through the pocket, and an insertion received in the pocket of the page-like structure.

2. An appointment calendar according to claim 1, in which the insertion comprises a sheet of material folded to create two leaves, one leaf being received in the pocket of the structure and the second leaf lying freely on top of the pocket such that it is visible when the book is open to the structure.

* * * * *